US011808076B2

(12) United States Patent
Tannoury et al.

(10) Patent No.: US 11,808,076 B2
(45) Date of Patent: Nov. 7, 2023

(54) MODULAR DOOR

(71) Applicants: Mark Tannoury, Andover, MA (US); Jasmine Tannoury, Andover, MA (US); Tony Tannoury, Andover, MA (US)

(72) Inventors: Mark Tannoury, Andover, MA (US); Jasmine Tannoury, Andover, MA (US); Tony Tannoury, Andover, MA (US)

( * ) Notice: Subject to any disclaimer, the term of this patent is extended or adjusted under 35 U.S.C. 154(b) by 32 days.

(21) Appl. No.: 17/513,434

(22) Filed: Oct. 28, 2021

(65) Prior Publication Data

US 2022/0127897 A1 Apr. 28, 2022

Related U.S. Application Data

(60) Provisional application No. 63/106,441, filed on Oct. 28, 2020.

(51) Int. Cl.

| | |
|---|---|
| ***E06B 3/26*** | (2006.01) |
| ***E06B 3/72*** | (2006.01) |
| ***E06B 5/00*** | (2006.01) |
| *E06B 3/70* | (2006.01) |

(52) U.S. Cl.

CPC ..... *E06B 3/26* (2013.01); *E06B 3/72* (2013.01); *E06B 5/003* (2013.01); *E06B 2003/7011* (2013.01)

(58) Field of Classification Search

None

See application file for complete search history.

(56) References Cited

U.S. PATENT DOCUMENTS

| | | | | | |
|---|---|---|---|---|---|
| 5,012,616 | A * | 5/1991 | Martin | E06B 5/003 | 49/501 |
| 5,230,180 | A * | 7/1993 | Tweedt | E06B 1/60 | 49/495.1 |
| 5,470,184 | A * | 11/1995 | Chandler | F16B 37/14 | 52/312 |
| 5,497,588 | A * | 3/1996 | Martin | E06B 3/72 | 52/476 |
| 5,651,651 | A * | 7/1997 | Spencer | F16B 41/005 | 411/910 |
| 5,704,178 | A * | 1/1998 | Ciao | B01F 27/91 | 52/DIG. 9 |
| 6,125,910 | A * | 10/2000 | Pepperell | E06B 9/01 | 160/381 |

(Continued)

*Primary Examiner* — Marcus Menezes

(74) *Attorney, Agent, or Firm* — Rimon PC; Marc S. Kaufman

(57) ABSTRACT

A secondary door can be attached to a primary frame of a primary door. At least one anchor mechanism includes a post element attached to the primary frame and an anchor that can be selectively attached to the post element, the anchor includes at least one of and ornamental and a functional element. The secondary door includes a secondary frame, at least one door slab, and at least one hinge coupling the at least one door slab to the secondary frame. A least one hole is formed in the secondary door so that the post element of the anchor mechanism can extend through the at least one hole and the anchor can be attached to the post element to secure the secondary door to the primary frame. The anchor also can be attached to the post when the secondary door is not secured to the primary frame.

2 Claims, 13 Drawing Sheets

(56) References Cited

U.S. PATENT DOCUMENTS

| | | | | |
|---|---|---|---|---|
| 7,712,268 | B1 * | 5/2010 | Guthrie | E06B 5/003 52/202 |
| 9,038,335 | B1 * | 5/2015 | Eck | E06B 1/6061 52/204.597 |
| 2006/0150524 | A1 * | 7/2006 | Kibbel | E05B 63/14 49/501 |
| 2006/0156361 | A1 * | 7/2006 | Wang | H04N 7/186 725/105 |
| 2006/0185271 | A1 * | 8/2006 | Christensen | E06B 9/02 52/202 |
| 2008/0163554 | A1 * | 7/2008 | Kibbel | E06B 1/14 49/381 |
| 2008/0313979 | A1 * | 12/2008 | Holland | E06B 9/02 52/202 |
| 2009/0090062 | A1 * | 4/2009 | Pandorf | E06B 9/04 49/50 |
| 2009/0284600 | A1 * | 11/2009 | Wang | H04N 7/186 348/374 |
| 2012/0159826 | A1 * | 6/2012 | Eichner | E06B 3/72 40/779 |
| 2013/0180188 | A1 * | 7/2013 | Motosko, II | F16B 33/00 411/366.1 |
| 2014/0078407 | A1 * | 3/2014 | Green | A47F 3/043 348/836 |
| 2014/0259948 | A1 * | 9/2014 | Oberbroeckling | E06B 3/5892 49/463 |
| 2015/0082702 | A1 * | 3/2015 | Walter | E06B 9/04 49/56 |
| 2019/0048649 | A1 * | 2/2019 | Koenitz | E06B 1/32 |
| 2020/0042969 | A1 * | 2/2020 | Ray | G07F 11/40 |
| 2020/0392780 | A1 * | 12/2020 | Vitello | E06B 7/30 |
| 2021/0087875 | A1 * | 3/2021 | Roberts | B60J 1/2094 |
| 2021/0293474 | A1 * | 9/2021 | Lee | G06V 20/20 |

* cited by examiner

MODULAR DOOR

BACKGROUND

It is well known to used secondary doors, sometimes referred to as "storm doors", to supplement that insulation of a primary door against temperature, wind, and precipitation. Typically, a storm door is made of relatively thin metal or wood and includes a frame and a slab attached to the frame with one or more hinges. The frame is attached to a primary door frame to place the storm door immediately outside of the primary door so that the slab of the storm door can be opened and closed, by pivoting on the hinges, to allow access to the primary door.

Often storm doors detract from the aesthetic qualities of the primary door. Also, the storm door is often not required in certain seasons, such as spring and summer. However, conventionally, storm doors are attached to the door frame of the primary door using wood screws, bolts, anchors and the like; all which make it difficult to remove the screen door and which leave holes in the door frame of the primary door when the storm door is removed. As a result, most storm doors are left in place relatively permanently. It is known to provide removable door panels, such as glass panels and screen panels, for storm doors. Also, it is known to utilize "quick release" hinges for door slabs generally. While these elements can address some of the issues noted above, they still leave the storm door frame in place and do not allow flexible functional and ornamental changes to the primary door frame. It is also well known to have various functional elements adjacent a door, such as security cameras, lock keypads and video displays. However, these elements all detract from the aesthetic qualities of the primary door.

SUMMARY

The invention relates to a door, such as a storm door, that has modular components for attaching the door to a door frame primary door and for ornamental and functional customization of the storm door and primary door in a convenient manner.

A first disclosed implementation is a door assembly for attaching a secondary door to a primary frame of a primary door, the door assembly comprising: at least one anchor mechanism, the anchor mechanism including a post element attached to the primary frame and an anchor that can be selectively attached to the post element, wherein the anchor includes at least one of and ornamental and a functional element; a secondary door including a secondary frame, at least one door slab, and at least one hinge coupling the at least one door slab to the secondary frame; wherein at least one hole is formed in the secondary from whereby the post element of the anchor mechanism can extend through the at least one hole and whereby the anchor can be attached to the post element to thereby secure the secondary door to the primary frame; and wherein the anchor can be attached to the post when the secondary door is not secured to the primary frame.

BRIEF DESCRIPTION OF THE DRAWING

The foregoing summary, as well as the following detailed description of the invention, will be better understood when read in conjunction with the appended drawings. For the purpose of illustrating the invention, there are shown in the drawings various illustrative embodiments. It should be understood, however, that the invention is not limited to the precise arrangements and instrumentalities shown. In the drawings.

DETAILED DESCRIPTION

Figure 1A:
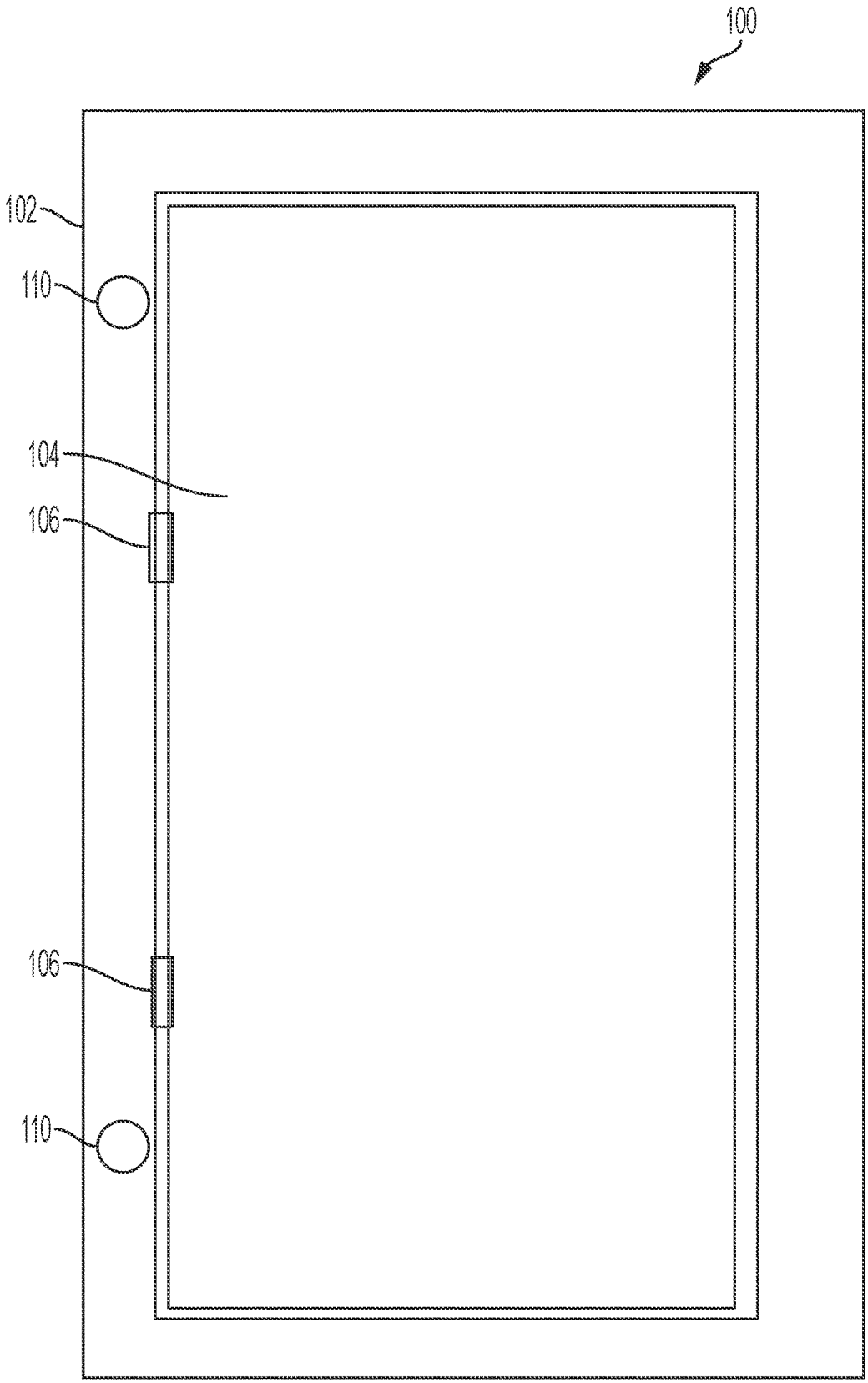
FIG. 1*a* illustrates a primary door adapted to use the secondary door apparatus of disclosed implementations.

Certain terminology is used in the following description for convenience only and is not limiting. The words "bottom," "top," "lower" and "upper" designate directions in the drawings to which reference is made. Unless specifically set forth herein, the terms "a," "an" and "the" are not limited to one element but instead should be read as meaning "at least one." The terminology includes the words noted above, derivatives thereof and words of similar import.

FIG. 1*a* illustrates primary door 100 adapted for use with disclosed implementations. Primary door 100 includes primary frame 102, primary slab (the moving portion of a door) 104 and hinges 106. All of these elements can be similar to conventional doors. Additionally, primary door 100 includes anchor assemblies 110 which are described in greater detail below.

Figure 1B:
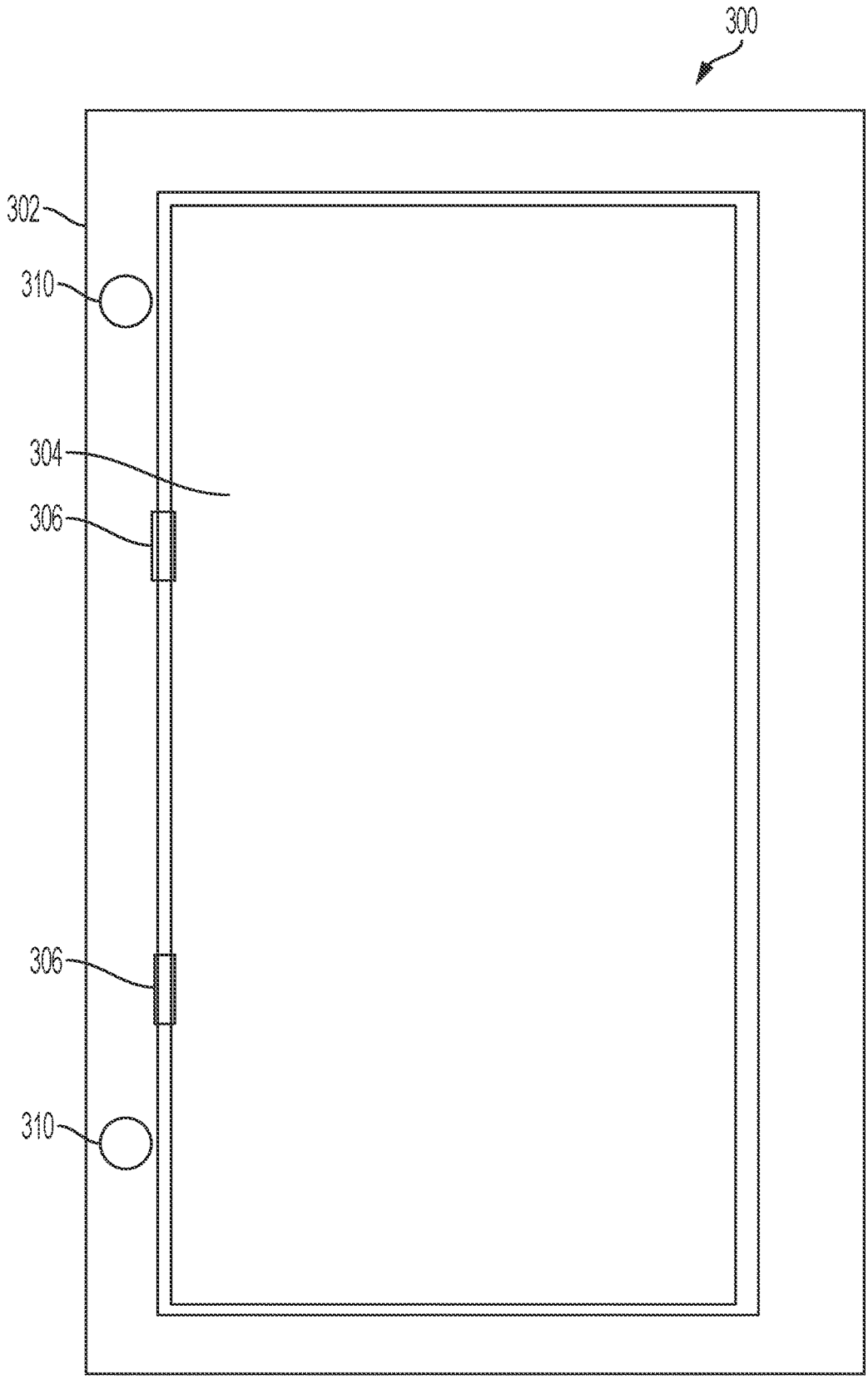
FIG. 1*b* illustrates a secondary door in accordance with disclosed implementations.

FIG. 1*b* illustrates secondary door 300 (a storm door assembly for example) adapted for use with disclosed implementations. Secondary door 300 includes secondary frame 302, secondary slab (the moving portion of a door) 304 and hinges 306. All of these elements can be similar to conventional doors. Additionally, secondary door 300 includes holes 310 formed in secondary frame 302, the purpose of which is described below.

Figure 2:
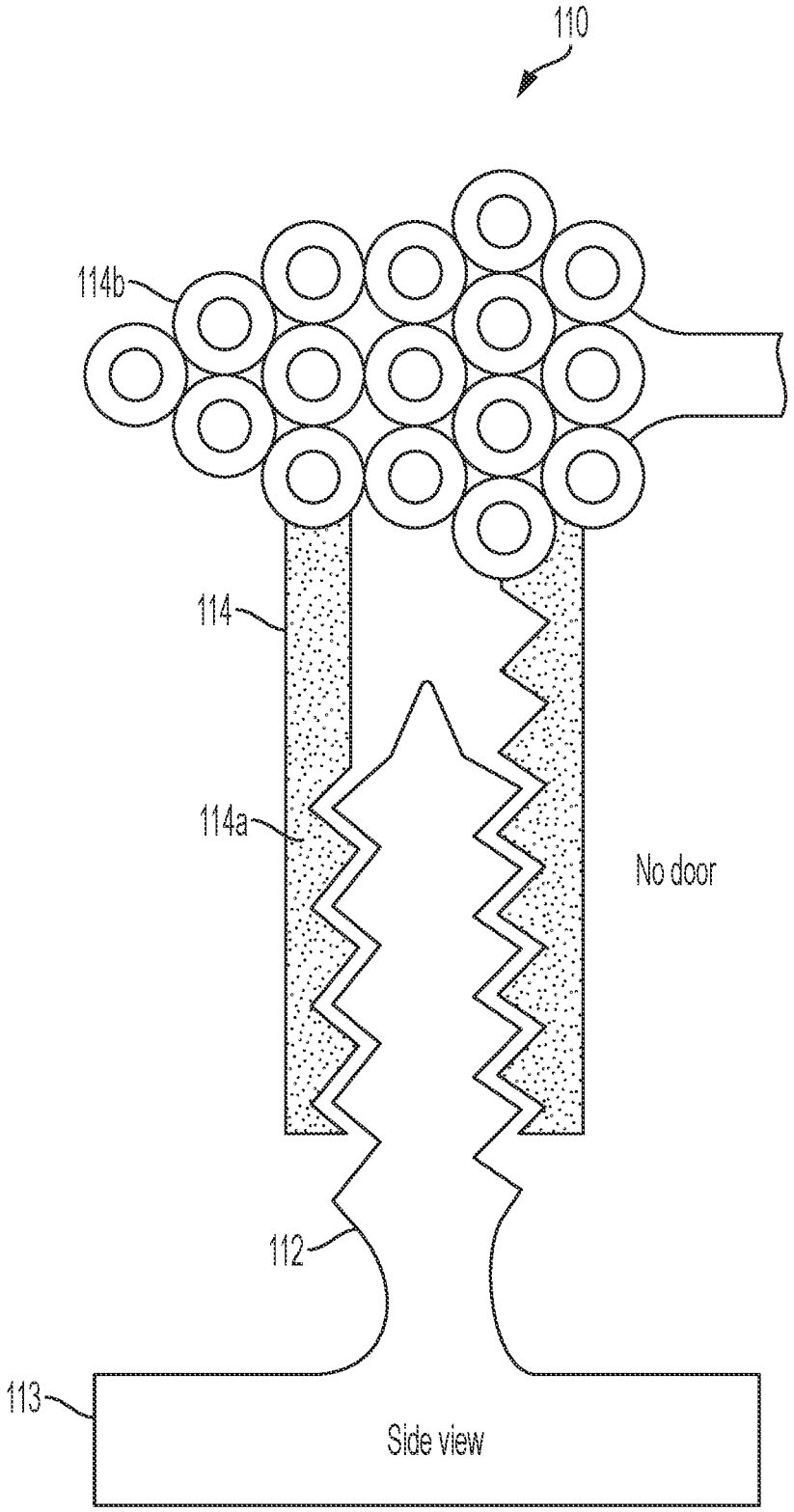
FIG. 2 illustrates an example of an anchor mechanism, in partial section, in accordance with disclosed implementations.

FIG. 2 illustrates an example anchor assembly 110 in greater detail. Anchor assembly 110 includes post 112 and anchor (also referred to as a "knob" herein) 114. anchor 114 includes collar 114*a* and cap 114*b*. Cap 114*b* in this example is ornamental (shaped as a bunch of grapes). A base 113 of post 112 is adapted to be fixedly attached to the frame of a primary door, such as frame 102 of FIG. 1. In this example, post 112 and collar 114*a* have corresponding threads formed thereon to allow anchor 114 to be selectively and removably attached to post 112.

Figure 3:
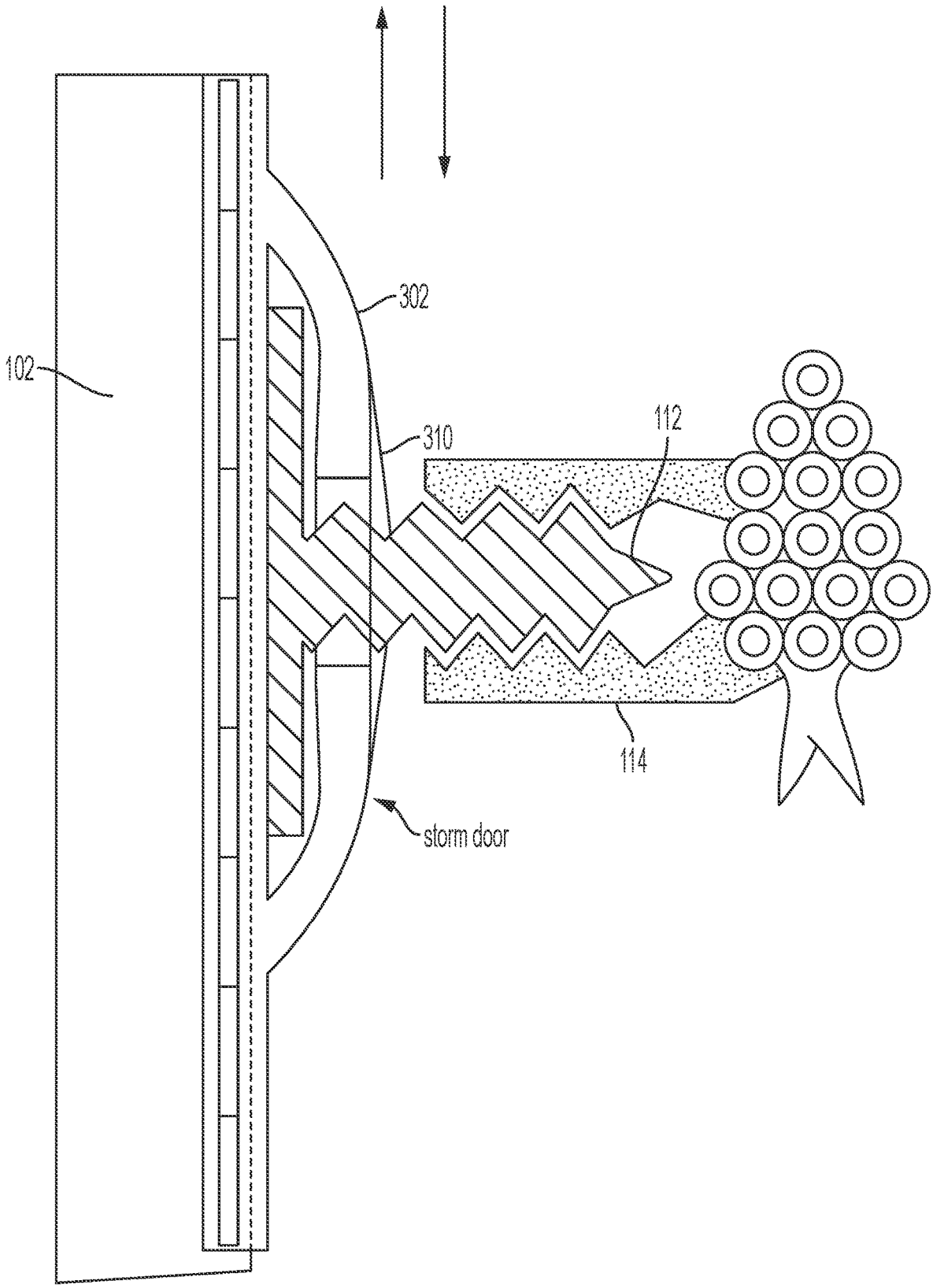
FIG. 3 illustrates an example of an anchor mechanism, in partial section, while supporting a secondary door in accordance with disclosed implementations.

As shown in FIG. 3. post 112 can be affixed to primary frame 102 and frame 302 of a storm door assembly can include holes 310 formed therein so that post 112 can extend through the holes 310 and frame 302 can be sandwiched between frame 102 and anchor 114, when anchor 114 is attached to post 112. In this manner, multiple anchor assemblies 110 can be used to attach a storm door assembly to a frame of a primary door. Further, the storm door assembly can be easily removed, by removing anchors 114 and pulling the storm door assembly off of posts 112. Subsequently, anchors 114 can be replaced on posts 112, as ornamental decorations in this example. As described in detail below, Anchors 114 can also include various functional elements.

Figure 4:
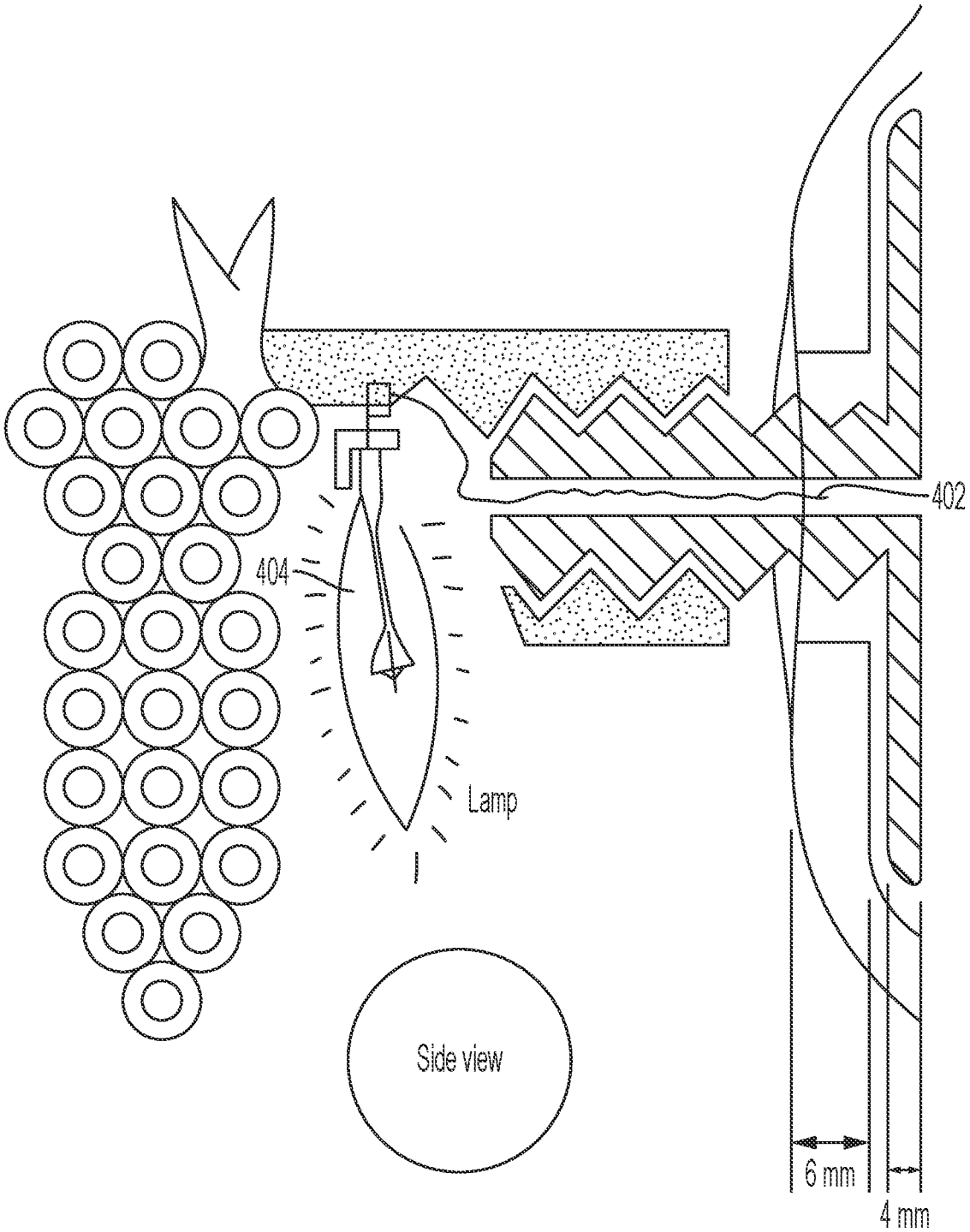
FIG. 4 illustrates an example of an anchor mechanism, in partial section, having a light an electrical element in accordance with disclosed implementations.

For example, as shown in FIG. 4, Anchor 112 or 114 can include an electric lighting element 404. In this example, electrical connections to a power source can be accomplished through a wire or other conductor 402 extending through anchor assembly 110. As will be described below, various functional elements can be incorporated into the disclosed implementations and any power or communication conductors or other components can be included as will become apparent to one of ordinary skill in the art based on this disclosure.

Figure 5:
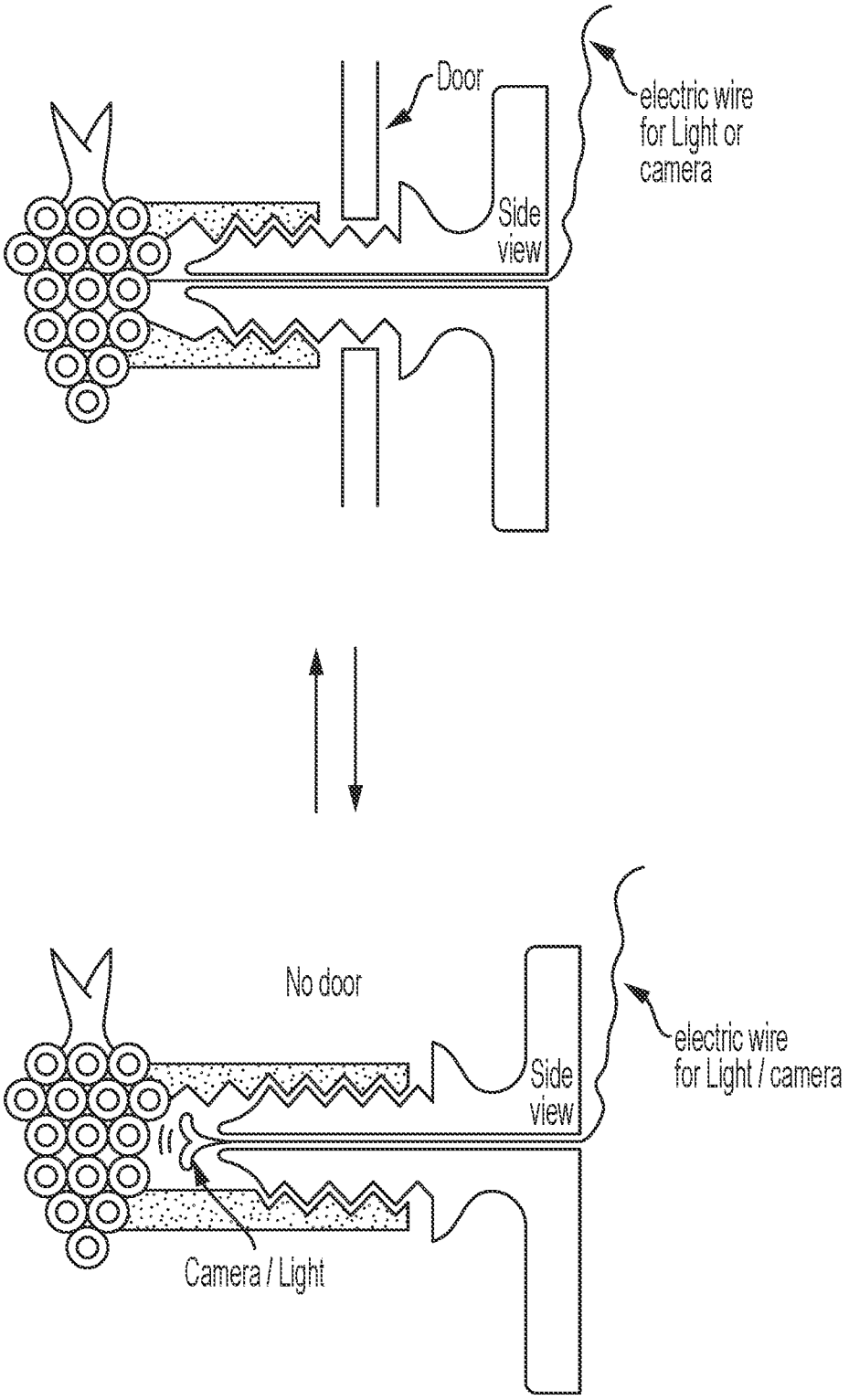
FIG. 5 illustrates an example of an anchor mechanism, in partial section, having an electrical element in accordance with disclosed implementations.

FIG. 5 illustrates another example of a functional element in an anchor. In FIG. 5, the storm door assembly is attached to the primary door in the example at top. In the example at the bottom, the anchor is disposed on the post without the storm door assembly.

Figure 6:
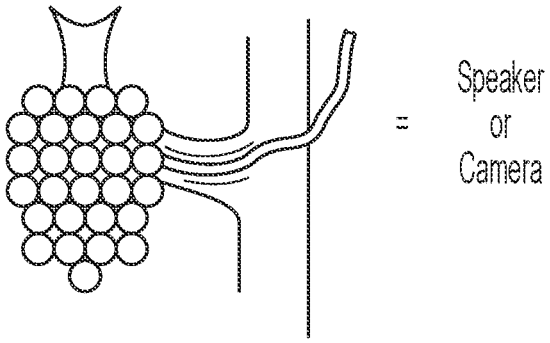
FIG. 6 illustrates examples of functional anchors in accordance with disclosed implementations.
Figure 6:
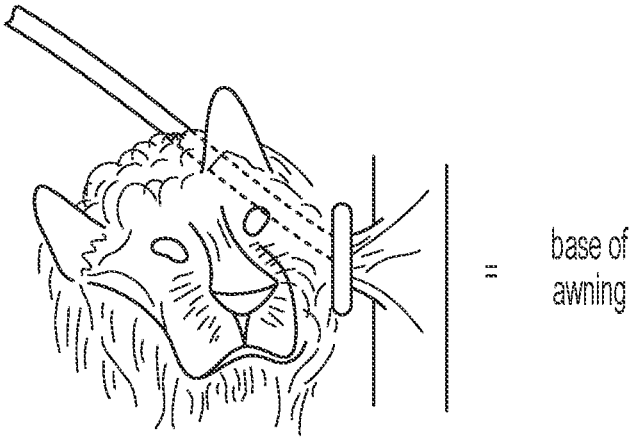
Figure 6:
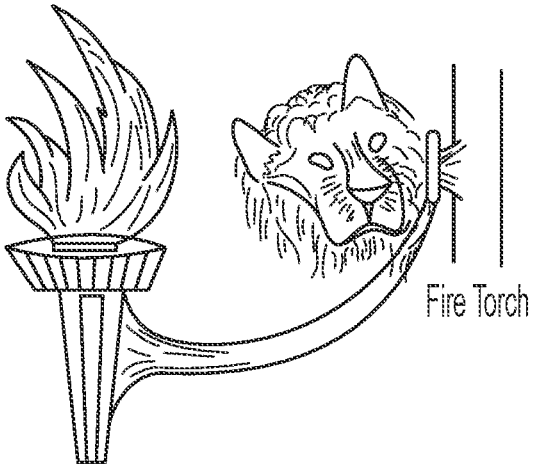

FIG. 6 illustrates various example of knobs that can be used in the disclosed implementations. At the top of FIG. 6 is a knob including a speaker, camera, light or other electrical device. In the middle of FIG. 6 is a knob that can be used to attach a support of an awning or other structure to the primary or secondary door. At the bottom of FIG. 6 is a knob with a torch. Knobs of the disclosed embodiments can include various mechanical and/or electrical functional elements that can be used when the secondary door is mounted or when the secondary door is removed from the primary door. Accordingly, the knobs provide various ornamental and functional elements to the primary door in an integral manner. As another example, a knob can incorporate a keypad for opening a lock or accomplishing other functions.

Figure 7:
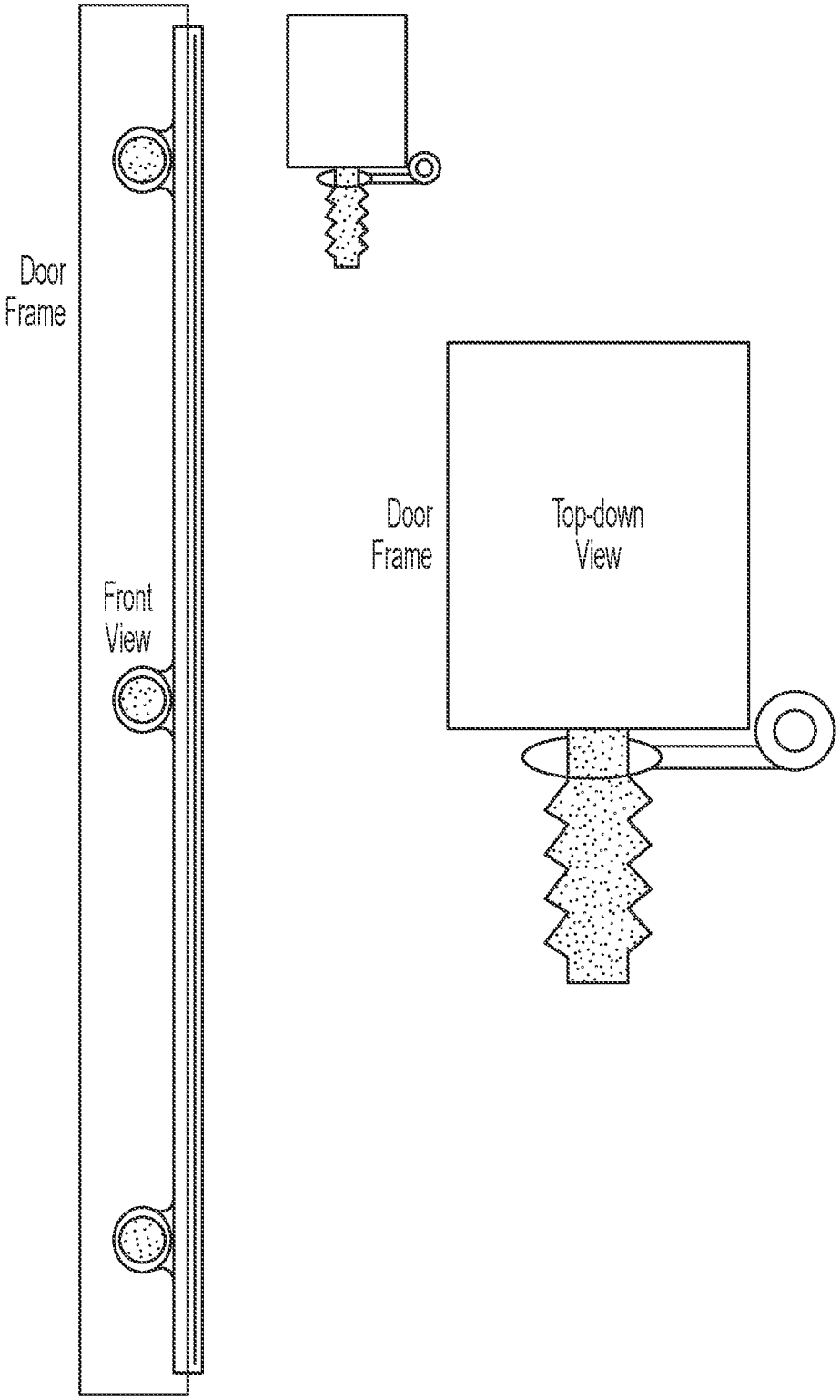
FIG. 7 illustrates another view of an anchor mechanism in accordance with disclosed implementations.
Figure 8:
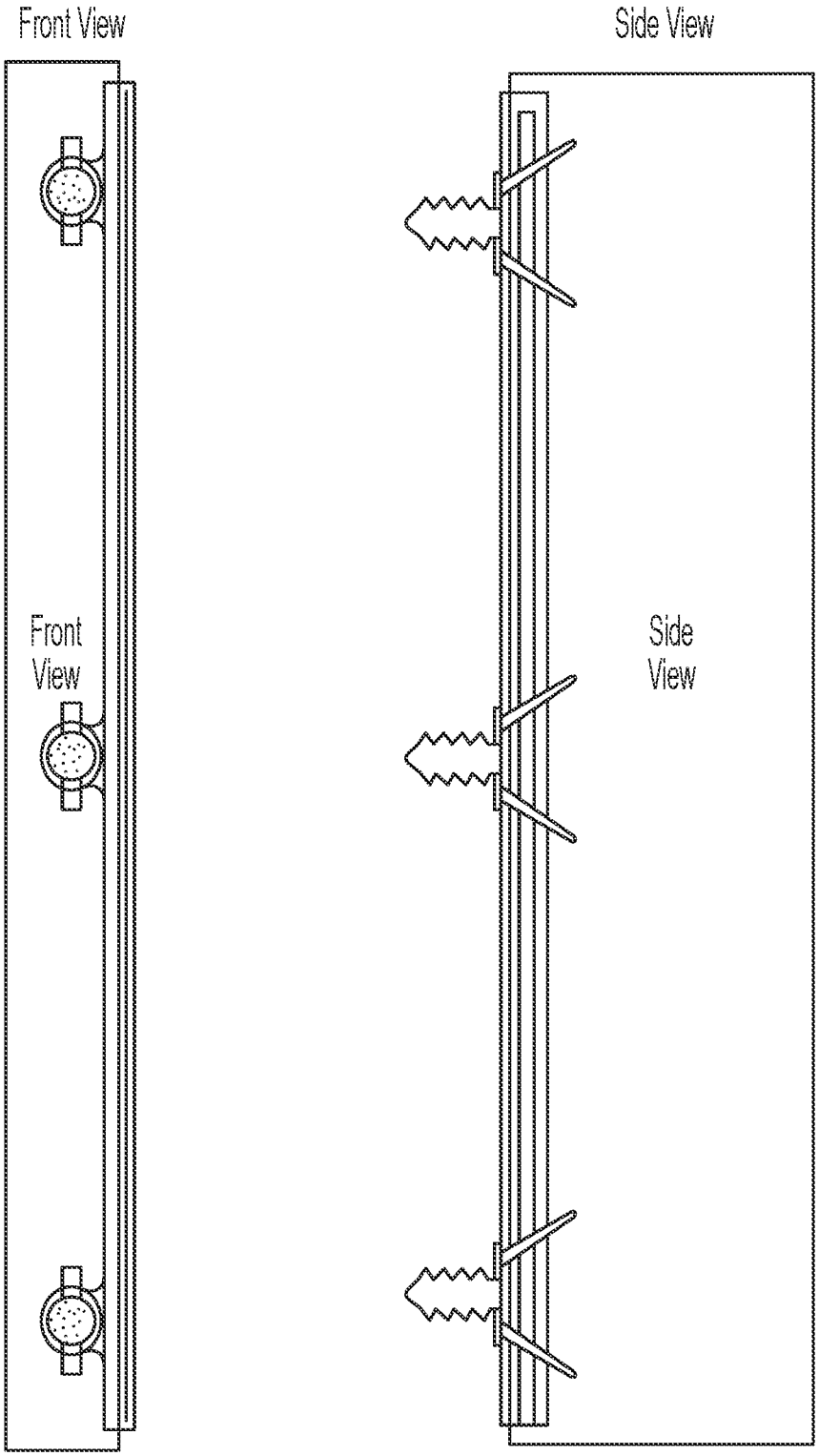
FIG. 8 illustrates another view of an anchor mechanism in accordance with disclosed implementations.
Figure 9:
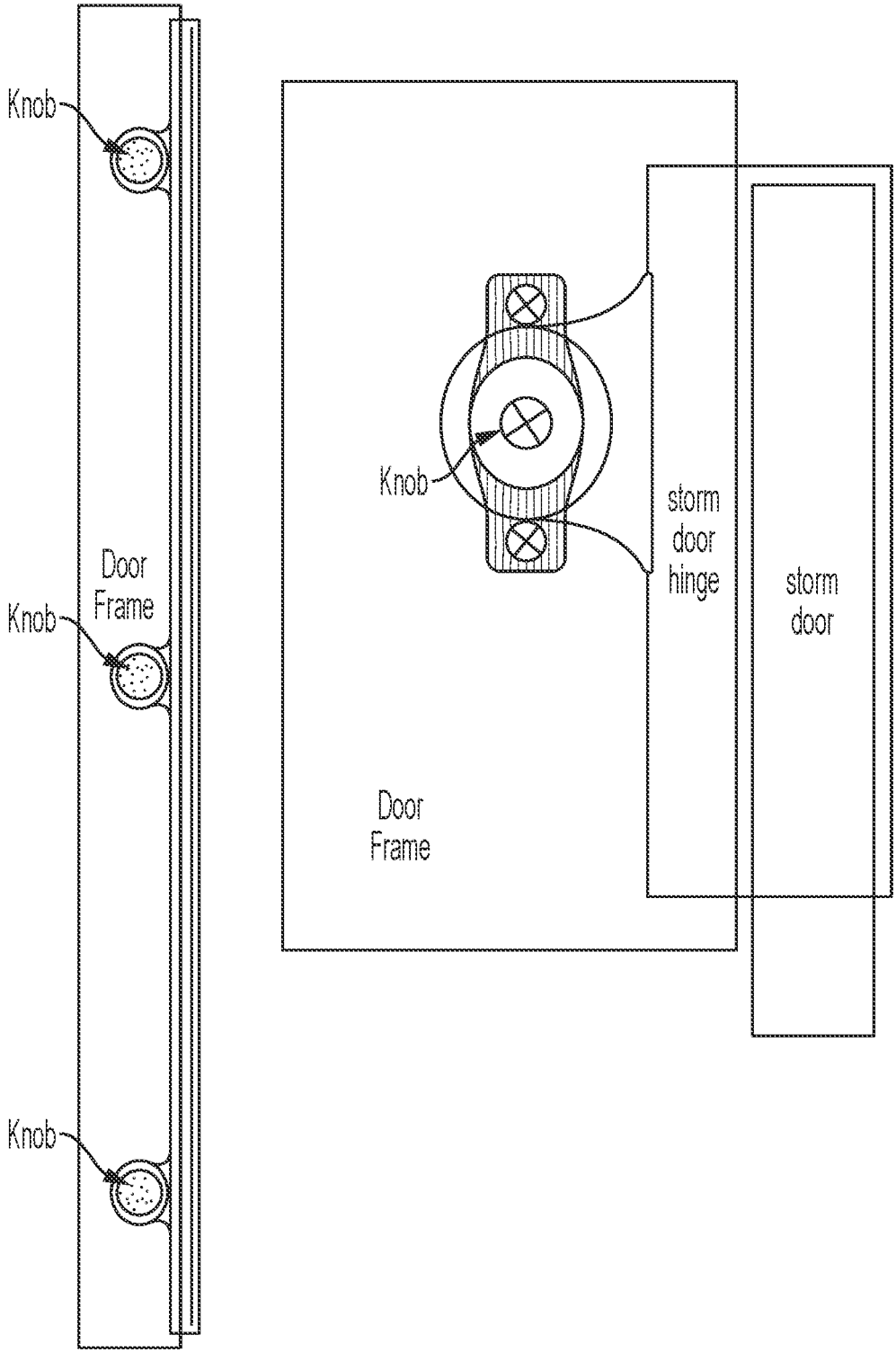
FIG. 9 illustrates another view of an anchor mechanism in accordance with disclosed implementations.
Figure 10:
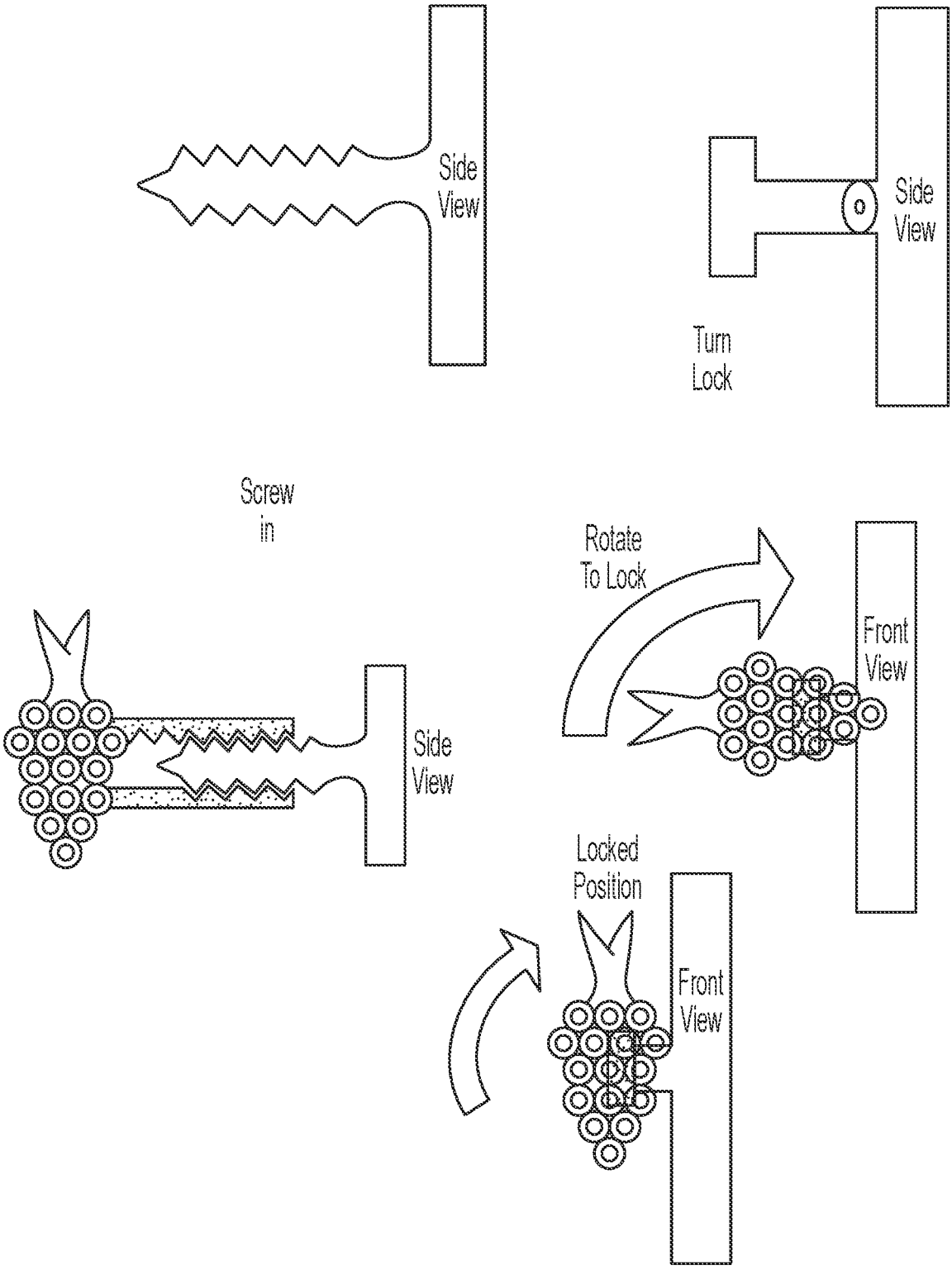
FIG. 10 illustrates various anchor mechanism anchor/knobs in accordance with disclosed implementations.

FIG. 7 shows another example configuration in which a post that is integrally mounted to the primary door frame. FIG. 8 shows a mechanism for attachment of the posts of FIG. 7 to a primary door frame. FIG. 9 illustrates an example of an anchor mechanism that attached directly to a storm door hinge; thus removing the need for the secondary frame of the examples described above. FIG. 10 illustrates various mechanisms for securing the knob to the post, including screw threads, and cooperating protrusions and recesses to provide a rotate to lock feature.

Figure 11:
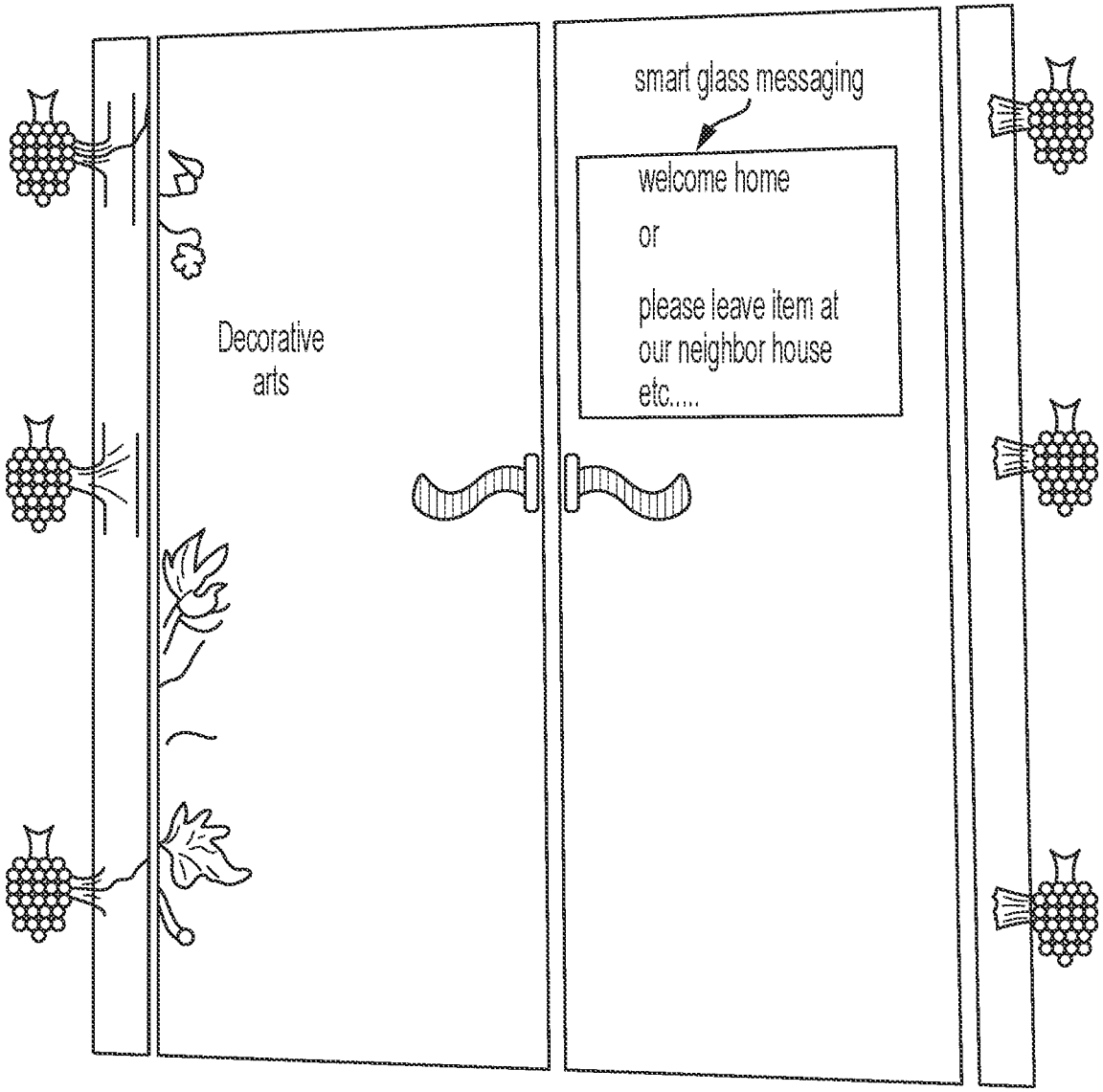
FIG. 11 illustrates a secondary door having a display panel in accordance with disclosed implementations.
Figure 12:
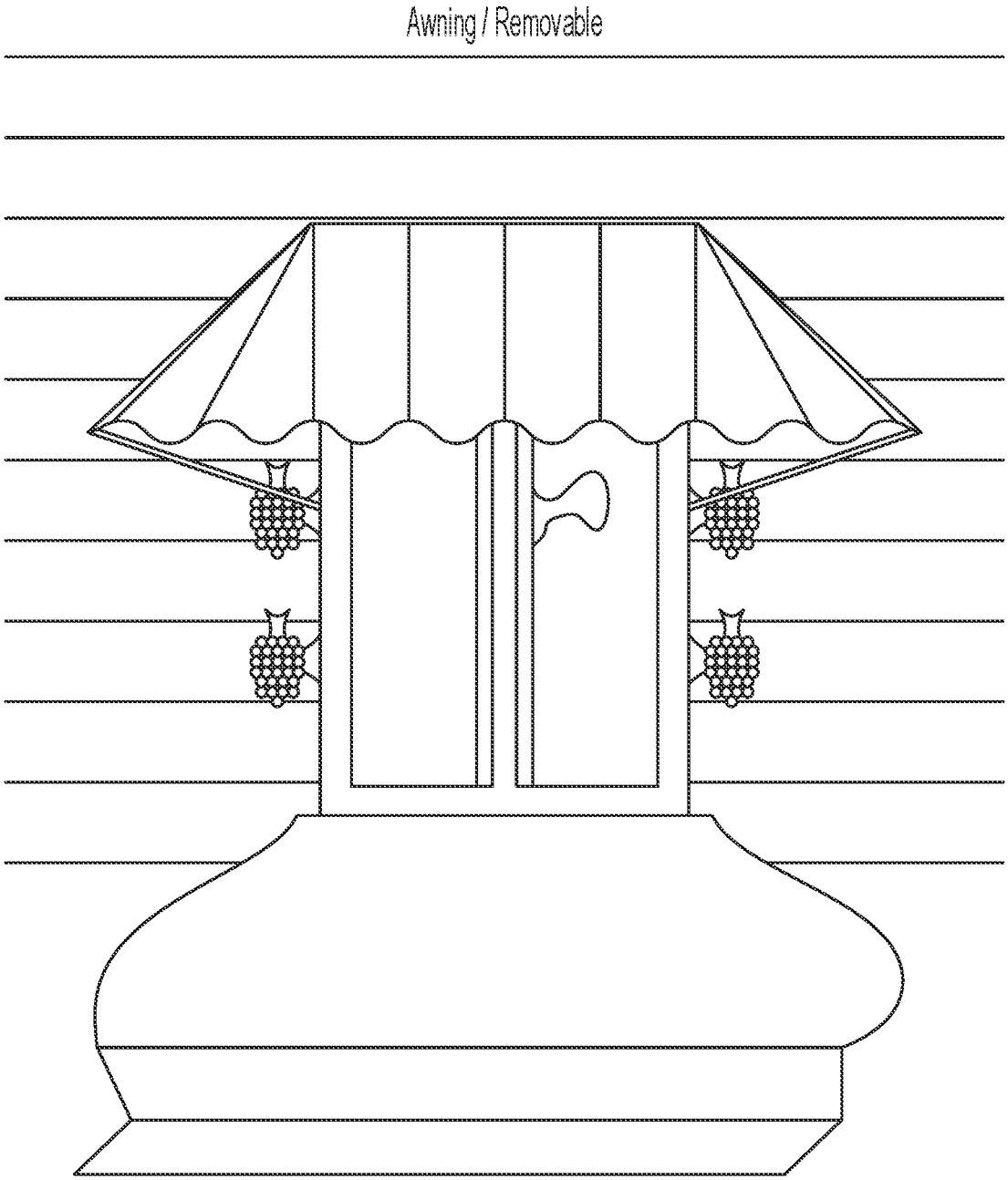
FIG. 12 Illustrates an awning supported by the disclosed implementations.

FIG. 11 illustrates and example where a smart glass display is incorporated in the slab of a storm door to provide messaging and other communication. The display can be computed to various computing devices over known networks, such as Wi-Fi, and ethernet.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed:

1. A door assembly for attaching a secondary door to a primary frame of a primary door, the door assembly comprising:

at least one anchor mechanism, the anchor mechanism including a post element fixedly attached to the primary frame and a single piece anchor that can be selectively attached to the post element, wherein the anchor includes an ornamental and a functional component;

the secondary door including a secondary frame, at least one door slab, and at least one hinge coupling the at least one door slab to the secondary frame;

wherein at least one hole is formed in the secondary door frame whereby the post element of the anchor mechanism can extend through the at least one hole and whereby the anchor can be attached to the post element to thereby secure the secondary door to the primary frame;

wherein the anchor can be attached to the post element when the secondary door is not secured to the primary frame to thereby cover the post element in a decorative and functional manner, and wherein at least one of a camera, a light, a microphone, and a keypad is mounted to the anchor functional component.

2. The door assembly of claim 1, wherein the door slab includes a digital display device.

* * * * *